US009580970B2

(12) United States Patent
Stowe et al.

(10) Patent No.: US 9,580,970 B2
(45) Date of Patent: Feb. 28, 2017

(54) CUTTING ELEMENT, TOOL AND METHOD OF CUTTING WITHIN A BOREHOLE

(71) Applicants: Calvin J. Stowe, Verone, TX (US); Rustom K. Mody, Bellaire, TX (US)

(72) Inventors: Calvin J. Stowe, Verone, TX (US); Rustom K. Mody, Bellaire, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 19 days.

(21) Appl. No.: 14/337,829

(22) Filed: Jul. 22, 2014

(65) Prior Publication Data

US 2014/0332273 A1 Nov. 13, 2014

Related U.S. Application Data

(63) Continuation-in-part of application No. 13/530,942, filed on Jun. 22, 2012.

(51) Int. Cl.
*E21B 10/573* (2006.01)
*E21B 10/43* (2006.01)

(52) U.S. Cl.
CPC ..... *E21B 10/5735* (2013.01); *E21B 10/43* (2013.01)

(58) Field of Classification Search
CPC .... E21B 10/55; E21B 10/5673; E21B 10/562; E21B 10/564; E21B 10/5676; E21B 10/5735; E21B 10/43
See application file for complete search history.

(56) References Cited

U.S. PATENT DOCUMENTS 3,374,917 A * 3/1968 Troy ..... A63H 33/08 206/504
5,971,676 A 10/1999 Kojima
6,464,434 B2 10/2002 Lynde
7,048,080 B2 5/2006 Griffo et al.
7,108,064 B2 * 9/2006 Hart et al. ..... 166/298
7,121,772 B2 10/2006 Krahula et al.
(Continued)

FOREIGN PATENT DOCUMENTS

JP 09150304 A 6/1997

OTHER PUBLICATIONS

Cutting & Wear Website, "Cutting Inserts," http://www.cwuk.com/page390.asp; accessed Jan. 5, 2010.
(Continued)

*Primary Examiner* — David Bagnell
*Assistant Examiner* — Kristyn Hall
(74) *Attorney, Agent, or Firm* — Cantor Colburn LLP

(57) ABSTRACT

A cutting element includes, a body having two planes, each of the two planes defining a plurality of edges, and a support extending from a first of the two planes. The support and the body are configured such that when the cutting element is resting against a planar surface such that at least one of the plurality of edges and the support are in contact with the planar surface, the second of the two planes forms an acute angle with the planar surface. Additionally, a protrusion extends laterally from at least one face of the body and an indentation is formed in at least one face of the body. The protrusion and the indentation are complementary to one another such that the protrusion of a first of the cutting elements is positionable within the indentation of a second of the cutting elements.

16 Claims, 5 Drawing Sheets

(56) References Cited

U.S. PATENT DOCUMENTS

| | | | | |
|---|---|---|---|---|
| 7,377,340 | B2 | 5/2008 | McDonough | |
| 7,543,661 | B2 * | 6/2009 | Griffo et al. | 175/375 |
| 2003/0031520 | A1 | 2/2003 | Hintze et al. | |
| 2005/0047885 | A1 | 3/2005 | Hyatt et al. | |
| 2014/0332273 | A1 | 11/2014 | Stowe et al. | |

OTHER PUBLICATIONS

Cutting & Wear—Hardfacing & Engineering for the Energy Industry; "Materials, equipment and services for oil companies"; Product Catalog; www.cwuk.com, South Yorkshire, United Kingdom.

Notification of Transmittal of the International Search Report and the Written Opinion of the International Searching Authority; PCT/US2011/023698; Korean International Patent Office; Mailed Sep. 27, 2011; ISR 5 pages; WO 3 pages.

Y. Suehiro et al., "Developments and Field test of a Stabilizer with FGM Blades"; Society of Petroleum Engineers, SPE Paper No. 59423; Apr. 25, 2000; 6 pages.

* cited by examiner

CUTTING ELEMENT, TOOL AND METHOD OF CUTTING WITHIN A BOREHOLE

CROSS REFERENCE TO RELATED APPLICATIONS

This application is a continuation-in-part of U.S. application Ser. No. 13/530,942 filed Jun. 22, 2012, the disclosure of which is incorporated by reference herein in its entirety.

BACKGROUND

Cutting tools, such as mills used in downhole applications, for example, can be made with a plurality of cutting elements that are adhered to a surface of a tool. The cutting elements can be randomly shaped particles made by fracturing larger pieces. Alternately, cutting elements can be precisely formed into repeatable shapes using processes such as pressing and sintering, for example. Regardless of the process employed to make the individual cutting elements, the elements are typically adhered to the mill with random orientations. These random orientations create disparities in maximum heights relative to a surface of the mill. Furthermore, angles of cutting surfaces relative to the target material are randomized and consequently few are near preferred angles that facilitate efficient cutting. In addition to uniformity, greater tool life than can be achieved with a single layer of cutting elements is often desired. If these elements are leaning at the desired angle, when the second layer is stacked on top, the top elements will tend to slide off due to gravity. The elements are typically adhered to each other with molten braze material which lubricates the interface between two elements, thereby further facilitating the top element sliding off the bottom element. Elements that address this undesirable condition would improve the manufacturing process. Multiple layers with the desired orientation and lean angle would be efficient, long lasting, and well received by the industry.

BRIEF DESCRIPTION

Disclosed herein is a c cutting element. The cutting element includes, a body having two planes, each of the two planes defining a plurality of edges, a support extending from a first of the two planes. The support and the body are configured such that when the cutting element is resting against a planar surface such that at least one of the plurality of edges and the support are in contact with the planar surface, and at least one of the plurality of edges on a second of the two planes is a cutting edge, the second of the two planes forms an acute angle with the planar surface. Additionally, a protrusion extends laterally from at least one face of the body and an indentation is formed in at least one face of the body. The protrusion and the indentation are complementary to one another such that the protrusion of a first of the cutting elements is positionable within the indentation of a second of the cutting elements.

Further disclosed herein is a cutting tool. The cutting tool includes, a trunk with at least one surface, and a plurality of the cutting elements disclosed above that are attached to the at least one surface and are oriented such that a first support and at least one cutting edge of each of the plurality of cutting elements are in contact with the at least one surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
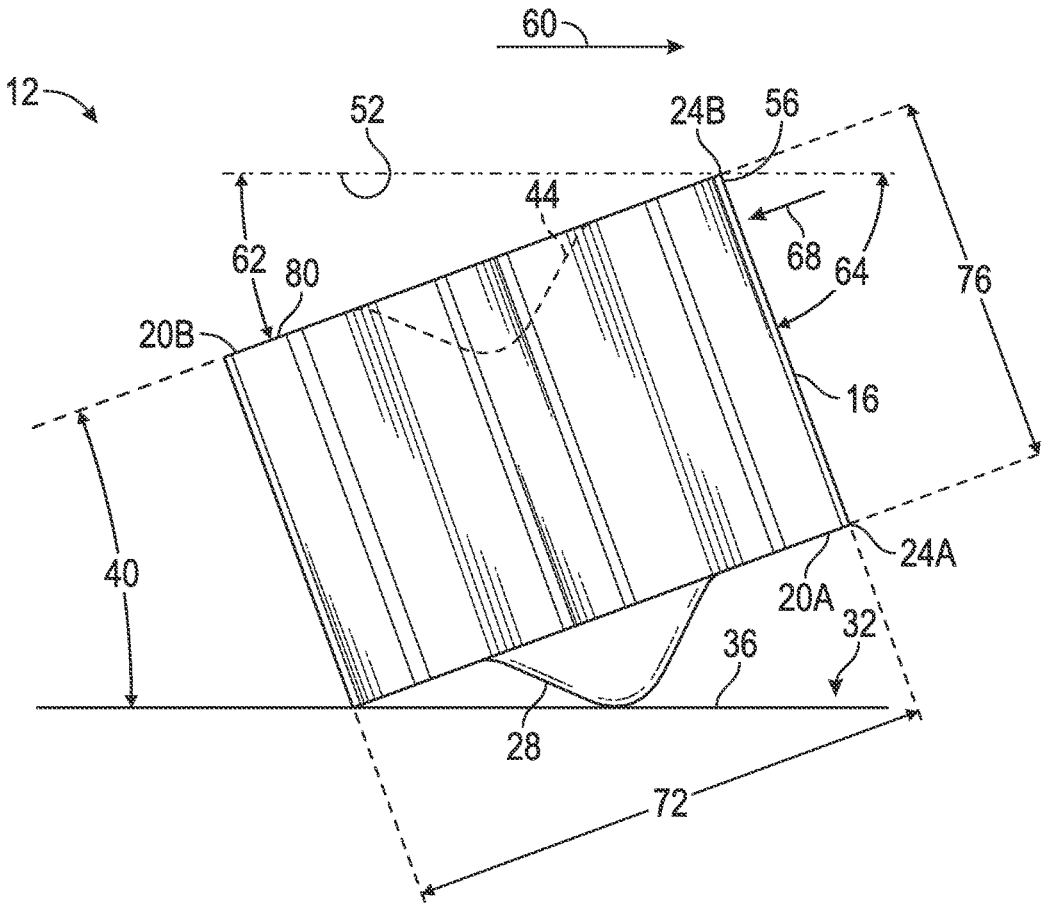
FIG. 1 depicts a side view of a cutting element disclosed herein.
Figure 2:
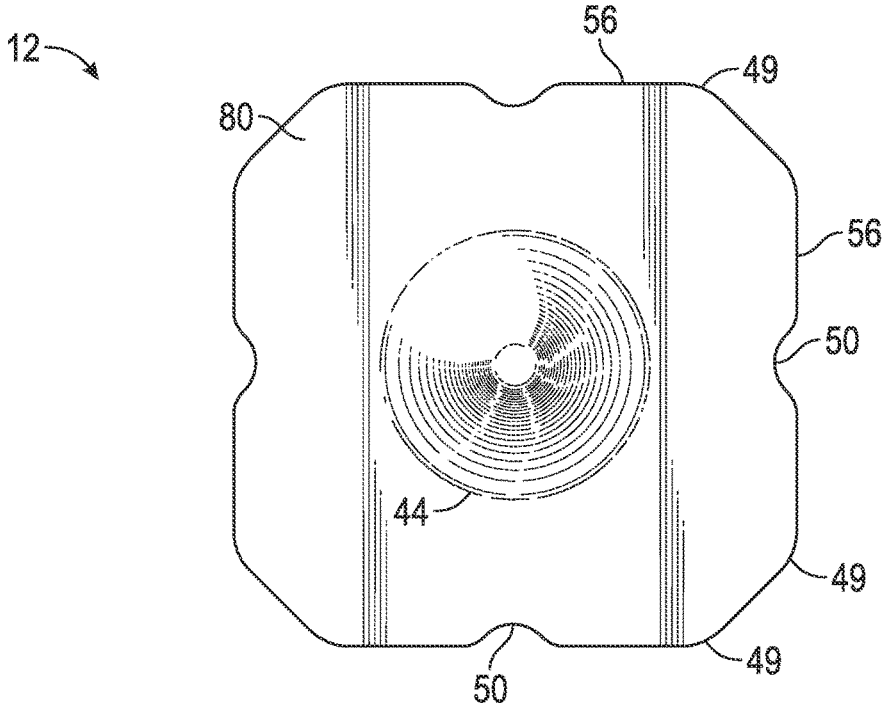
FIG. 2 depicts a top view of the cutting element of FIG. 1.

Referring to FIGS. 1 and 2, an embodiment of a cutting element disclosed herein is illustrated at 12. The cutting element 12 includes a body 16 and a support 28. The body 16 has a first plane 20A defining a plurality of edges 24A and a second plane 20B defining a plurality of edges 24B. The support 28 extends beyond the first plane 20A such that the cutting element 12 is restable upon a planar surface 32 with at least one of the edges 24A and the support 28 being simultaneously in contact with the planar surface 32. The planar surface 32 may be on a cutting tool 36 to which the cutting element 12 is attachable. It should be noted that a tool may have a surface that is not planar to which the cutting elements 12, 48 (see FIGS. 3-5) are attachable as well. With the cutting element 12 resting on the planar surface 32 the second plane 20B forms an acute angle 40 with the planar surface 32, and the edges 24B on the second plane 20B are cutting edges.

Figure 3:
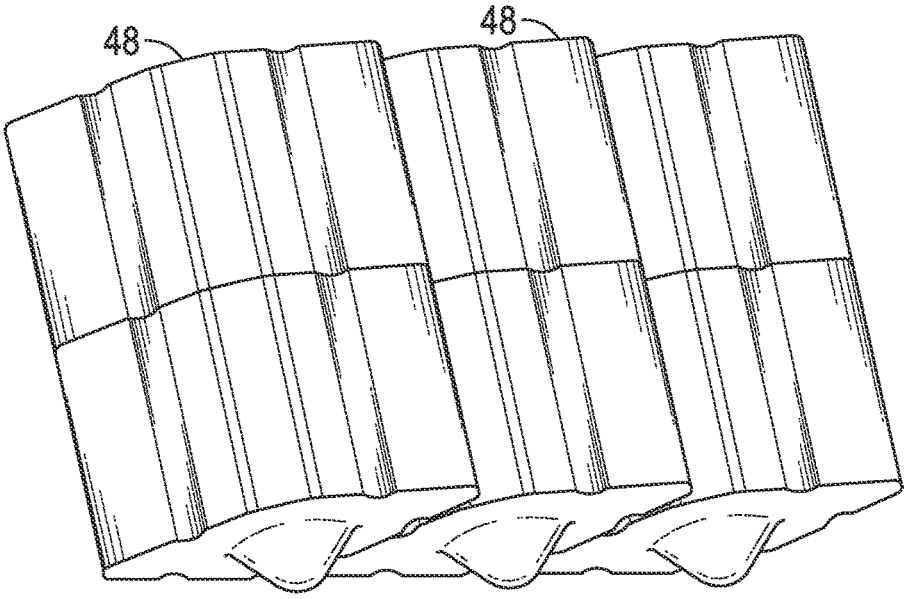
FIG. 3 depicts a perspective view of a three cutting elements disclosed herein each having two of the cutting elements of FIGS. 1 and 2 stacked together.
Figure 4:
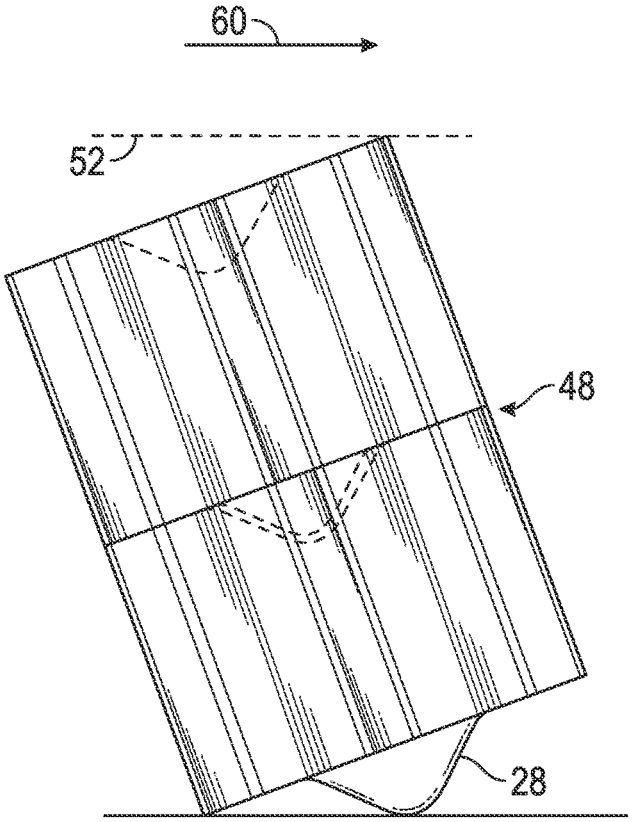
FIG. 4 depicts a side view of one of the cutting elements of FIG. 3.

Additionally referring to FIGS. 3 and 4, the second plane 20B has a recess 44 therein configured and sized to be receptive to the support 28 of another of the cutting elements 12 such that the second plane 20B of the other of the cutting elements 12 butts against the first plane 20A thereof. Two or more of the cutting elements 12 can be positioned relative to one another in this manner such that they are stacked and attached together to form an elongated cutting element 48. In embodiments wherein the cutting elements 12 that combined make one of the elongated cutting elements 48 are substantially the same size and shape the supports 28 and the recesses 44 can be configured to orient the cutting elements 12 together such that the second plane 20B of both of the cutting elements 12 form the same acute angle 40 with the planar surface 32. Although in the embodiment illustrated the recess 44 and the support 28 appear to allow one of the cutting elements 12 to be rotated relative to the other of the cutting elements 12 prior to them being attached together, embodiments wherein the recess 44 and the support 28 rotationally fix the cutting elements 12 to one another is an option. The fit of the support 28 within the recess 44 can also be used to provide alignment between the two cutting elements 12 prior to them being attached to one another.

Additionally, the planes 20A and 20B of the illustrated embodiment are geometrically similar to one another and are of the same size thereby resulting in the body 16 being a regular solid. Alternate embodiments are possible wherein the planes 20A and 20B are not geometrically similar to one another nor are they of the same size. A perimeter of each of the planes 20A, 20B that defines the edges 24A, 24B can have various shapes including, polygons, as well as shapes that approximate a polygon with deviations such as rounded corners 49 and grooves 50 shown in the Figures. Inclusion of the grooves 50 has the added feature of disrupting propagation of cracks in the cutting element 12 when such cracks intersect with the grooves 50. Also, formation of chips removed from a target 52 may be smaller than had the grooves 50 not been present since the grooves 50 in essence separate one of the cutting edges 24B into two or more such cutting edges 24B. Additionally, the planes 20A, 20B though shown as being parallel to one another in the embodiment of the Figures could instead be skewed relative to one another. By rotating one such configured element relative to another similarly configured element prior to attachment together such planes can be made to form selected acute angles relative to the planar surface 32.

The first plane 20A and the support 28 of the cutting element 12 can be configured such that the acute angle 40 has specific values. Experience shows that when the acute angle 40 is between 10 and 30 degrees the cutting edges 24B are effective at cutting the target 52 or work piece that the cutting element 12 moves relative to. And setting the acute angle 40 at about 20 degrees shows particularly effective cutting therewith. Experience further shows effective cutting when the cutting edges 24B are defined by 90 degree angles between the second plane 20B and a face 56 of the body 16. Further orienting the cutting elements 12 on the planar surface 32 of the cutting tool 36 such that movement of the cutting elements 12 in a direction along arrow 60 relative to the target 52 (the target 52 being stationary) results in a leading angle 64 between the face 56 and the target 52 and a trailing angle 62 between the second plane 20B and the target 52 that is quite effective for cutting the target 52.

Orienting the cutting elements 12 such that the face 56 forms the leading angle 64 with the target 52 also distributes loads imparted on the cutting elements 12, 48 in a direction of arrow 68 through a dimension 72 of the body 16. Such an orientation can enhance durability of the cutting elements 12, due to less fracturing of the element 12, particularly when the dimension 72 is set to be greater than a dimension 76 of the body 16.

Although a planar land 80 exists on the plane 20B between the edges 24B and the recess 44 in the illustrated embodiments, other embodiments without the planar land 80 are contemplated. Without the planar land 80 an alternate recess (not shown) could extend all the way to a cutting edge as could walls of an alternate support that would be complementary to such a recess.

Figure 5:
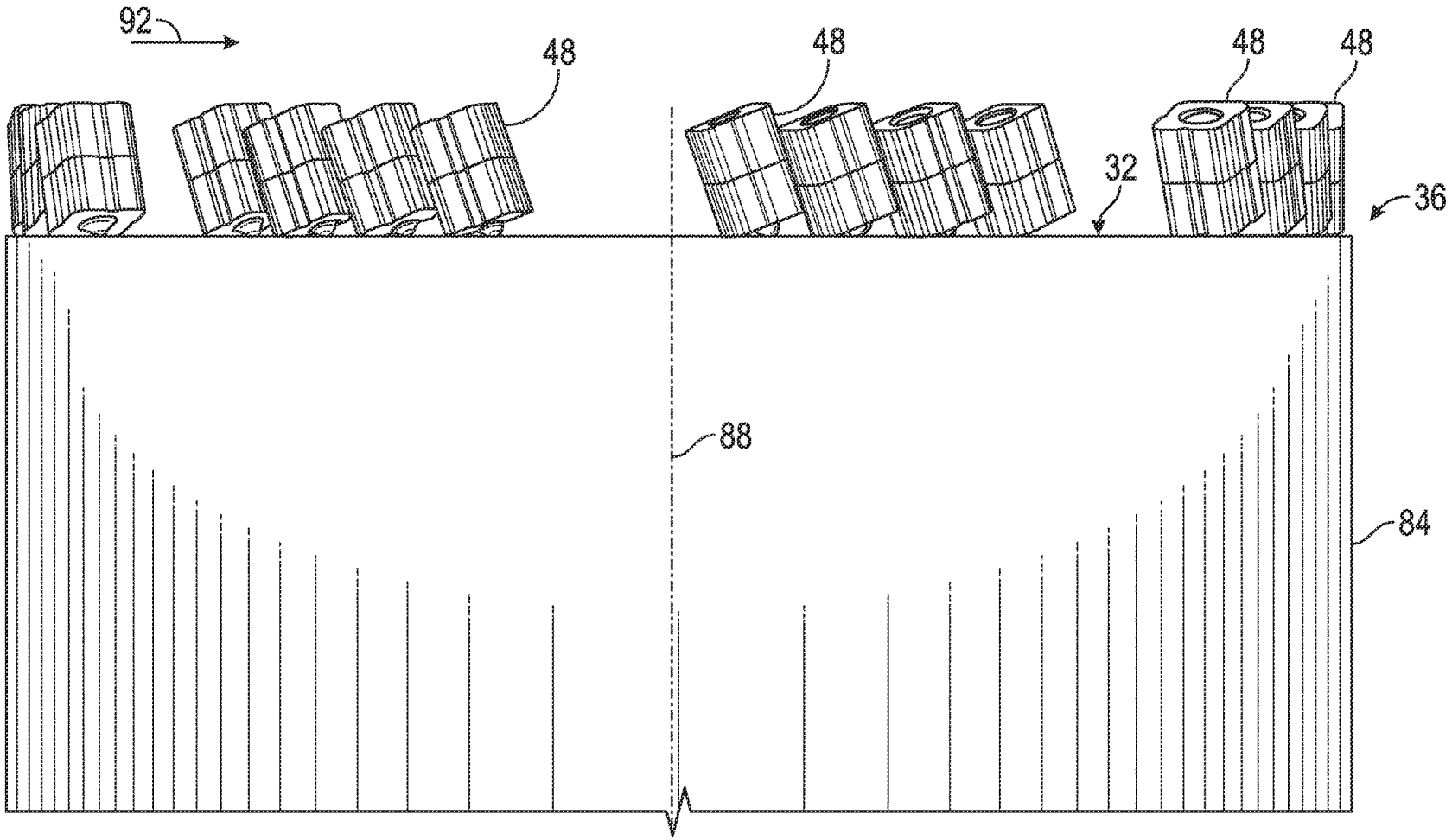
FIG. 5 depicts a side view of a portion of a cutting tool disclosed herein.

FIG. 5 depicts a side view of a portion of the cutting tool 36 disclosed herein. The tool 36 includes a trunk 84 that rotates about an axis 88 in a direction according to arrow 92. A plurality of the cutting elements 48 are attached to the surface 32 of the tool 36 such that they move relative to the target 52 as shown in FIGS. 1 and 4. Alternately, a combination of the cutting elements 48 and the cutting elements 12 can be attached to a surface of a single tool. The elements 48 can be oriented along radial spokes on the surface 32 either with or without the elements 12 positioned on the surface 32 in the spaces between the radial spokes.

The cutting tool 36 disclosed herein is well suited for cutting the target 52. In downhole applications for example wherein removal of the target 52 from an earth formation borehole is desired, the target 52 may consist of stone, earth, metal, ceramic, polymers, monomers and combinations of the foregoing. Fabricating the cutting elements 12, 48 of hard materials such as steel, tungsten carbide, tungsten carbide matrix, polycrystalline diamond, ceramics and combinations thereof, for example, allow for good cutting performance while also providing longevity of the tool 36 and the cutting elements 12, 48.

Figure 6:
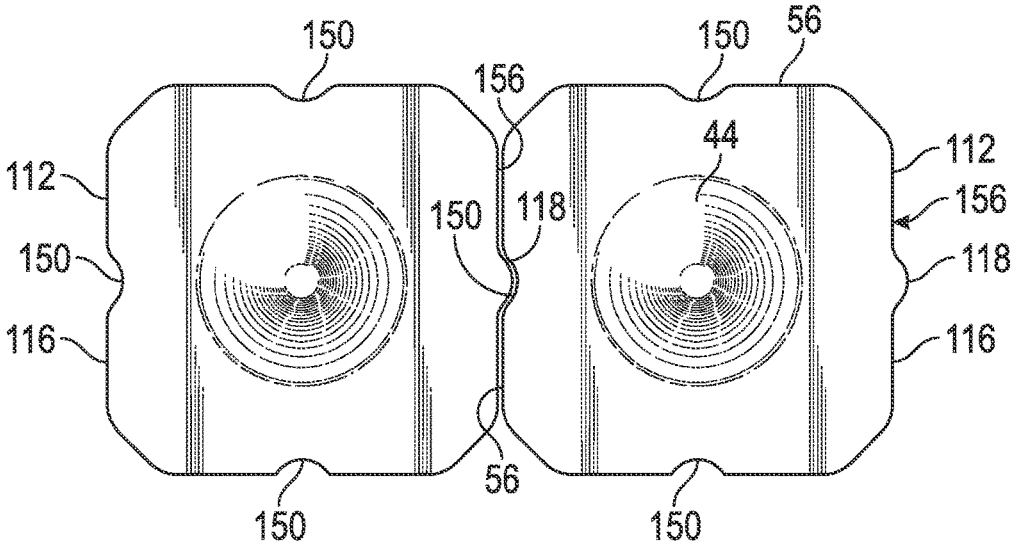
FIG. 6 depicts a top view of two cutting elements disclosed herein.
Figure 7:
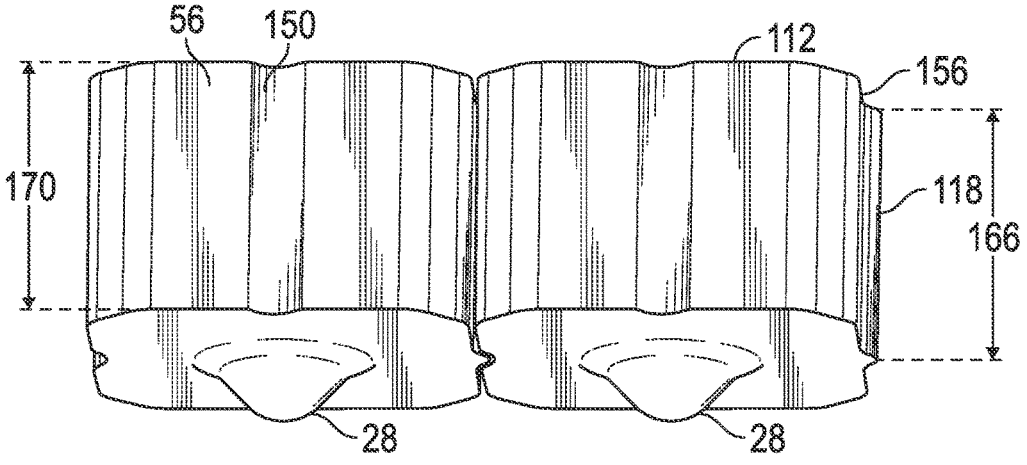
FIG. 7 depicts a side view of the two cutting elements of FIG. 6.
Figure 8:
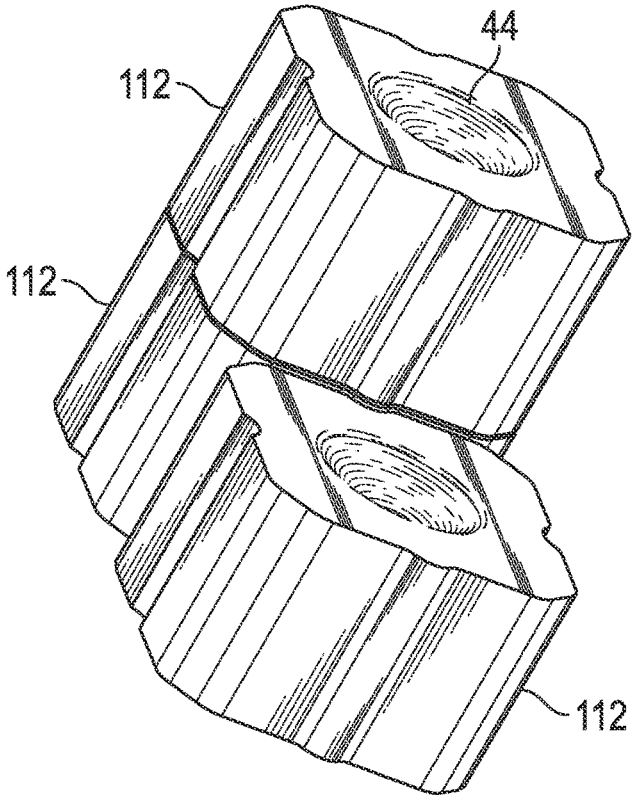
FIG. 8 depicts a perspective view of three of the cutting elements of FIG. 6.

Referring to FIGS. 6-8, an alternate embodiment of a cutting element disclosed herein is illustrated at 112. The cutting element 112 has similarities to the cutting element 12 and as such only the differences will be discussed herein and identified with new reference characters. Unlike the cutting element 12 the cutting element 112 includes a protrusion 118 that extends from a face 156 of a body 116 that defines the element 112. The protrusion 118 is complementary to an indentation 150 that in this embodiment is identical to the groove 50 in the face 56 of the body 16. The protrusion 118 is complements the indentation 150 such that the protrusion 118 fits well when positioned within the indentation 150. This complementary configuration of the protrusion 118 with the indentation 150 allows the face 156 to butt against the face 56 when the protrusion 118 is positioned within the indentation 150. As such the faces 56, 156 can be attached together with adhesives, for example.

Regardless of whether the faces 56, 156 are attached, the positional engagement of the protrusion 118 into the indentation 150 prevents relative motion between two cutting elements so engaged at least in a direction along arrow 158 that is in this embodiment parallel to the faces 56, 156 without disengaging the protrusion 118 from the indentation 150. This interlocking of the adjacent cutting elements 112 can provide greater durability of the cutting tool 36 by distributing loads experienced by one of the cutting elements 112 with an adjacent one of the cutting elements 112.

Since the cutting element 112 incorporates all the features of the cutting element 12 discussed above the cutting element 112 maintains all the benefits and features of the cutting element 12. As such, the cutting element 112 can be employed in all the applications that the cutting element 12 is employable.

The protrusion 118 illustrated extends a full dimension 166 of the face 156. Similarly, the indentation 150 extends a full dimension 170 of the face 56 to maintain complementary to the protrusion 118. However, other configurations could be employed that do not extend through the full dimensions 166 and 170 while not deviating from the engagement they provide.

Figure 9:
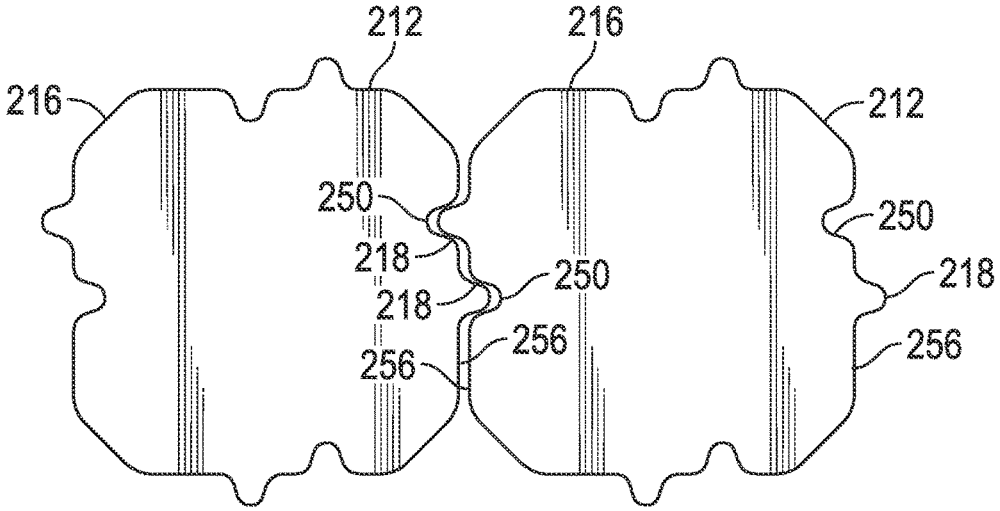
FIG. 9 depicts a top view of two cutting elements disclosed herein.

Referring to FIG. 9, an alternate embodiment of a cutting element disclosed herein is illustrated at 212. The cutting element 212 includes both a protrusion 218 and an indentation 250 on each face 256 of a body 216. Regardless of rotational orientation of one of the cutting elements 212 to an adjacent one of the cutting elements 212 there is always one of the protrusions 218 positionably engagable with one of the indentations 250.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A cutting element comprising:

a body having two planes, each of the two planes defining a plurality of edges;

a support extending from a first of the two planes, the support and the body being configured such that when the cutting element is resting against a planar surface such that at least one of the plurality of edges and the support are in contact with the planar surface, and at least one of the plurality of edges on a second of the two planes is a cutting edge, the second of the two planes forms an acute angle with the planar surface; and a protrusion extending laterally from at least one face of the body and an indentation formed in at least one face of the body, the protrusion and the indentation being complementary to one another such that the protrusion of a first of the cutting elements is positionable within the indentation of a second of the cutting elements.

2. The cutting element of claim 1, wherein the positioning the protrusion of the first of the cutting elements within the indentation of the second of the cutting elements allows a face of the first of the cutting elements from which the protrusion extends to butt against a face of the second of the cutting element having the indentation formed therein.

3. The cutting element of claim 2, wherein the positioning the protrusion of the first of the cutting elements within the indentation of the second cutting elements prevents relative movement of the two cutting elements in at least one direction parallel to butted faces of the two cutting elements.

4. The cutting element of claim 1, wherein the protrusion is elongated.

5. The cutting element of claim 1, wherein the protrusion extends across a full dimension of a face from which it extends.

6. The cutting element of claim 1, wherein the indentation is elongated.

7. The cutting element of claim 1, wherein the indentation extends across a full dimension of a face into which it is formed.

8. The cutting element of claim 1, wherein the protrusion extends from one face of the body and the indentation is formed in three faces of the body.

9. The cutting element of claim 1, wherein the body is symmetrical.

10. The cutting element of claim 1, wherein one of the protrusions extends from each face of the body and one of the indentations are formed in each face of the body.

11. An elongated cutting element comprising at least two of the cutting elements of claim 1 being stacked and attached together such that the support of a first of the at least two of the cutting elements engages in a recess of a second of the at least two of the cutting elements.

12. The elongated cutting element of claim 11, wherein the protrusions of the at least two cutting elements that form the elongated cutting element are positionable within the indentations of at least two other of the cutting elements that form another of the elongated cutting element.

13. A cutting tool comprising:

a trunk with at least one surface; and a plurality of the cutting elements of claim 1 being attached to the at least one surface being oriented such that a first support and at least one cutting edge of each of the plurality of cutting elements are in contact with the at least one surface.

14. The cutting tool of claim 13, wherein the protrusion of at least one of the plurality of cutting elements is positioned within the indentation in another of the plurality of cutting elements attached to the at least one surface.

15. The cutting tool of claim 13, wherein a face of the first of the cutting elements from which the protrusion extends is attached to a face of the second of the cutting elements in which the indentation is formed.

16. A method of cutting within a borehole comprising:

rotating the cutting tool of claim 13 within a borehole;

contacting a target in the borehole with one or more of the plurality of the cutting elements; and cutting the target.

* * * * *